United States Patent [19]

Esterlin et al.

[11] Patent Number: 4,928,570

[45] Date of Patent: May 29, 1990

[54] METHOD AND SYSTEM FOR TRANSMITTING A COMMAND TO START UP A DEVICE ON BOARD A MISSILE

[75] Inventors: Jacques Esterlin, Checy; Guy Le Parquier, Paris; Jean Pierre Roux, St. Cyr En Val, all of France

[73] Assignee: Thomson Brandt Armements, Boulogne Billan Court, France

[21] Appl. No.: 300,228

[22] Filed: Jan. 24, 1989

Related U.S. Application Data

[63] Continuation of Ser. No. 69,987, Jul. 6, 1987, abandoned.

[30] Foreign Application Priority Data

Jul. 8, 1986 [FR] France ..... 86 09892

[51] Int. Cl.[5] ..... F42C 11/06; F42C 15/06

[52] U.S. Cl. ..... 89/6.5; 89/1.814; 102/215

[58] Field of Search ..... 102/206, 215; 89/6, 89/6.5

[56] References Cited

U.S. PATENT DOCUMENTS

| | | | |
|---|---|---|---|
| 3,500,746 | 3/1970 | Ambrosini | 102/215 |
| 3,680,062 | 7/1972 | Cricchi | 89/6.5 |
| 4,099,466 | 7/1978 | Redmond et al. | 89/6.5 |
| 4,424,745 | 1/1984 | Magorian et al. | 102/215 |
| 4,496,010 | 1/1985 | Chapman, III | 89/6.5 |
| 4,577,561 | 3/1986 | Perry | 102/215 |

FOREIGN PATENT DOCUMENTS

| | | |
|---|---|---|
| 2036058 | 12/1970 | France . |
| 2055899 | 5/1971 | France . |
| 2250095 | 5/1975 | France . |
| 2577036 | 8/1986 | France . |
| 1375691 | 11/1974 | United Kingdom . |

*Primary Examiner*—Charles T. Jordan
*Assistant Examiner*—Michael J. Carone
*Attorney, Agent, or Firm*—Cushman, Darby & Cushman

[57] ABSTRACT

The invention pertains to a system and method for transmitting temporal data relating to the starting of a device placed in a missile launched from a carrier system. The command to fire the missile is transmitted to the missile from the carrier system by means of a firing control wire. The method consists in using the control wire to also transmit the temporal data to the device specifying when to start up the device after the missile has been launched.

3 Claims, 1 Drawing Sheet

METHOD AND SYSTEM FOR TRANSMITTING A COMMAND TO START UP A DEVICE ON BOARD A MISSILE

This is a continuation of Application Ser. No. 07/069,987, filed July 6, 1987, abandoned, which was abandoned upon the filing hereof.

BACKGROUND OF THE INVENTION

1. Field of the Invention

The present invention pertains to devcies, such as warheads, placed in missiles such as rockets, which have to be started up when the missile is in flight. These missiles may be launched from fixed or mobile launching stations and especially from rocket-launchers.

2. Description of the Prior Art

Certain warheads, such as dart charges (for example armour-piercing charges), have to be fired before the missile reaches its target, for these payloads send out one or more volleys of projectiles in a manner which is determined in advance. If these volleys are to be effective, the charge must be triggered precisely, i.e., at a determined distance from the target. For example, dart-charged heads have a maximum effectiveness when they are launched at about 500 metres from the target, it being possible to launch the carrier missile at several thousand metres from the target. Therefore, the missile should have timing data so that the charge can be set off at the required time.

At the outset, the command to fire the missile is transmitted to it through a control wire. The timing data for starting up the warhead, on the other hand, is tranmitted to it by means of induction coils placed both on the carrier system and on the ammunication. However, ths system of commannd transmission has one disadvantage, namely, that it is necessary to have a carrier system fitted with coils of this type in order to be able to transmit the timing commands when the missile to be launched has a payload which must function during flight. Thus, there is a problem here relating to the standardization of both the carrier system and its ammunication.

SUMMARY OF THE INVENTION

The invention is aimed at removing this disadvantage by modifying the system and the method for transmitting timing commands pertaining to the starting of the warhead.

The object of the invention is a method and a system for transmitting temporal data relating to the starting up of a device, this device being placed in a missile launched from a carrier system. The command for firing the missile in accordance with the invention is transmitted from the carrier system by means of a single firing control wire. In other words, the present invention relates to a method and system wherein the fire control wire is also used to transmit the timing data to the device.

BRIEF DESCRIPTION OF THE DRAWINGS

The invention and its characteristics will be better understood from the following description made with reference to the appended figures, of which.

DESCRIPTION OF THE PREFERRED EMBODIMENT

Figure 1:
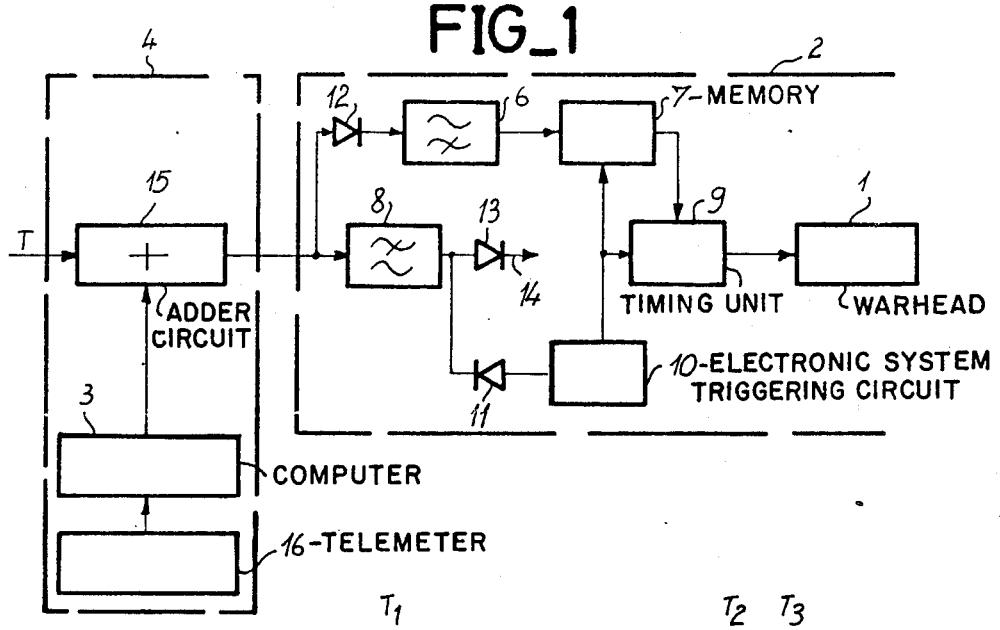
FIG. 1 is a diagram of the system according to the invention.

With reference to FIG. 1, the device 1 which has to be started up, for example, a warhead, is in a missile 2 such as a rocket. This missile is launched from a carrier system 4 which, in this case, happens to be a rocket-launching tube.

As in the prior art, the timing signal for starting up the device 1 is given by means of a telemeter 16 and a computer 3 of the carrier system. At the moment of firing, the signal to fire the missile is given to it by a control wire 5, on the initiative of the gunner. This signal to fire the missile may be the front edge of a positive pulse, as and shown in FIG. 2.

According to the invention, the signal sent to the guided missile just before it is fired (this signal being the timing signal for the starting of the device) is transmitted also by the control wire 5 and not by coils placed both on the carrier system and the periphery of the missile. It must be noted that, until now, this timing data has been transmitted in analog form. According to the present invention, however this data can be transmitted in digital form, thus making it possible to use the on-board computer 3 when the carrier system is an aircraft, the missile then being a rocket.

Figure 3:
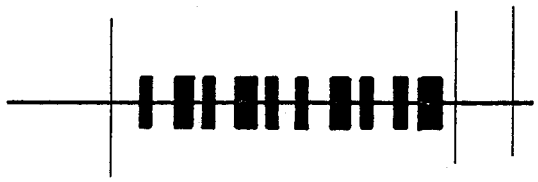

With reference to FIG. 3, the signal carrying the data relating to the time at the end of which a device has to be triggered comprises pulses on the order of one Mhz at intervals of about 100 microseconds. In FIG. 3, the bits are shown with different pulse durations (for example, 100 microseconds for the "zeros" and 300 microseconds for the "ones", but this is only an example of an embodiment).

Figure 2:
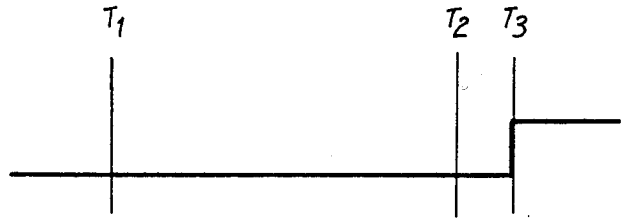
FIGS. 2, 3, 4 and 4 are forms of signals that play a role in the system according to the invention.

In the missile 2, a high-pass filter 6 is used which lets through the frequencies of the pulses. The output of this filter is applied to a memory 7 which stores the successive bits constituting the time data. Furthermore, the control wire 5 is also applied to the input of a low-pass filter 8 which lets through the pulse frequencies for firing the missile and for starting up the device. The output of this wire is applied to a timing unit 9 which is triggered upon the command of the front edge of the positive pulse as shown in FIG. 2 to begin a timing operation.

Figure 4:
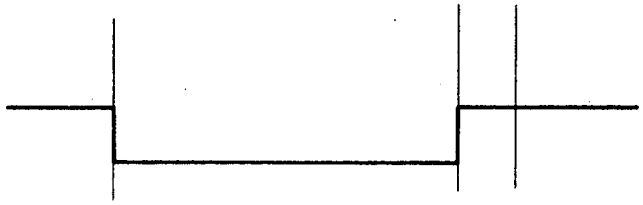

Before this firing of the missile, there is a signal to sensitize and start the electronics system used to record the time data. This signal is shown in FIG. 4 and may consist of a negative pulse of a duration which is at least as long as that of the digital time data transmission. This signal is applied to an electronic system triggering circuit 10 by means of a diode 11 that lets through only negative voltages. This circuit for triggering the electronics system sensitizes the memory 7 and the timing unit 9 as well as a clock, if any, designed for the functioning of the various circuits.

Figure 5:
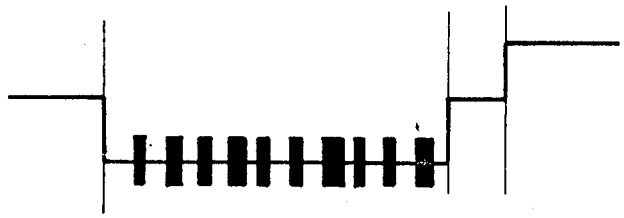

Since these signals have to be transmitted by the same control wire 5, they are superimposed, by means of an adder circuit 15, in the manner shown in to FIG. 5. First, there appears the negative pulse that sensitizes the electronics system at the moment T1. This sensitizing process lasts until the instant T2, the interval T1, T2 being greater than the interval needed to transmit the bits that form the time data which has to be transmitted to the memory. At the instant T2, the signal is once again returned to a reference potential which may be nil. At an instant T3, which is later than the instant T2, the positive information is transmitted, this information corresponding to the firing of the propellent of the guided missile. The frequencies used for the triggering pulses of the electronics system and the firing of the propellent are of the same magnitude and may go through the lo-pass filter 8.

In the same way that there is a first diode 11 before the circuit for starting the electronics system, it is possible to use a second diode 12 before the input of the high-pass filter 6 for letting through only positive pulses, and a similarly, a third diode 13 may be inserted on the wire strand 14 designed to fire the propellent of the guided missile.

It is observed firstly that the circuits and the element needed to transmit the time data, which were made up of coils or windings and additional circuits, are now eliminated. Secondly, few new elements are needed to apply the invention because only two filters and three diodes, are added with the timing unit and the memory existing already in the former circuits, these elements functioning in an analogous manner as before.

A missile or rocket fitted with these few elements can obviously be adapted to be launched by a carrier system on which there is a telemeter and electronic circuits capable of creating the digital signal that constitutes the time data, and of applying it to the control wire 5. The device is then a warhead and, in particular, a dart charge. It is therefore possible to adapt it to various support systems such as aircraft (planes or helicopters) or rocket-launchers carried by infantrymen, ammunition or missiles (which may or may not be guided), such as rockets comprising elements which have just been described. This factor therefore greatly increases the possibilities of adapting guided missiles carrying warheads to different support systems.

What is claimed is:

1. A system for starting up a device placed in a missile launched from a carrier system, comprising:

a control wire for receiving from said carrier system temporal data specifying a predetermined time period after launch of said missile which must elapse before the start up of said device, and a missile firing command signal;

a first high pass filter connected to said control wire for passing said temporal data;

a memory connected to said control wire via said first filter, for storing said temporal data;

a timing unit which begins a timing operation upon receipt of said missile firing command signal;

a second low pass filter connected to said control wire for passing said missile firing command signal and said temporal data, an output of said second filter being applied to a firing command signal input of said missile; and an electronic system triggering circuit, connected to said output of said second filter, for starting the timing operation has commenced for the predetermined time period specified by said stored temporal data.

2. A method for the transmission of temporal data relating to the starting up of a device placed in a missile launched from a carrier system, comprising the steps of:

transmitting said temporal data from said carrier system to said device as a digital electrical signal by means of a firing control wire, comprising the steps of transmitting by components controlling start up of said device to trigger the starting of receiving of said temporal data by said components, and then transmitting said temporal data as a series of digital pulses having a time duration at the end of which said device must function; and after said temporal data transmitting step, transmitting a command to fire a propellant of said missile from said carrier system to said missile by means of said firing control wire;

wherein said command transmitting step comprises the step of transmitting a pulse of a second polarity to said missile by means of said firing control wire, wherein said pulse of a first polarity is a negative pulse and said pulse of a second polarity is a positive pulse.

3. A system for starting up a device placed in a missile launched from a carrier system, comprising:

a control wire for receiving from said carrier system temporal data specifying a predetermined time period after launch of said missile which must elapse before the start up of said device, and a missile firing command signal;

a first filter connected to said control wire for passing said temporal data;

a memory, connected to said control wire via said first filter, for storing said temporal data;

a timing unit which begins a timing operation upon receipt of said missile firing command signal;

a second filter connected to said control wire for passing said missile firing command signal and said temporal data, an output of said second filter being applied to a firing command signal input of said missile;

an electronic system triggering circuit, connected to said output of said second filter, for starting the timing operation has commenced for the predetermined time period specified by said stored temporal data;

a first diode connected between said second filter and said electronic system triggering circuit so as to pass only negative pulses of said temporal data to said electronic system triggering circuit for triggering said memory and said timing unit, a second diode connected between said control wire and said first filter for passing only a positive pulses of said temporal data to said first filter, and a third diode connected to said output of said second filter to pass only positive pulses to said firing command signal input of said missile.

* * * * *